United States Patent [19]

Michels

[11] Patent Number: 4,649,574

[45] Date of Patent: Mar. 17, 1987

[54] GARMENT CLOSURE

[76] Inventor: Frank J. Michels, 744 Bluff St., Apt. 201, Carol Stream, Ill. 60187

[21] Appl. No.: 853,202

[22] Filed: Apr. 17, 1986

[51] Int. Cl.[4] ..... A41B 9/06; A41F 9/02

[52] U.S. Cl. ..... 2/235; 2/237; 2/DIG. 6

[58] Field of Search ..... 2/227, 235, 237, 221, 2/76, DIG. 6, 236

[56] References Cited

U.S. PATENT DOCUMENTS

| | | | |
|---|---|---|---|
| 191,505 | 5/1877 | Zoellner | 2/227 X |
| 666,246 | 1/1901 | Hennderson | 2/237 |
| 876,099 | 1/1908 | Schmidt | 2/235 |
| 4,069,514 | 1/1978 | Palmieri et al. | 2/235 |
| 4,481,682 | 11/1984 | Hall | 2/DIG. 6 |

FOREIGN PATENT DOCUMENTS

| | | | |
|---|---|---|---|
| 197306 | 4/1958 | Austria | 2/235 |
| 1263391 | 5/1961 | France | 2/DIG. 6 |
| 2929 | of 1886 | United Kingdom | 2/235 |
| 12826 | of 1890 | United Kingdom | 2/235 |
| 766834 | 1/1957 | United Kingdom | 2/235 |

*Primary Examiner*—H. Hampton Hunter
*Attorney, Agent, or Firm*—Andrew F. Zikas

[57] ABSTRACT

A highly dependable, symmetrically neat, non-abrasive, quick releasing-closing and selectively adjustable garment closure device useful on sporting trousers, such as martial art pants or Gi pants, comprising a pair of juxtapositionable, somewhat triangularly-shaped flap panels respectively secured along opposing side areas of a trousers rear-enclosure segment and extending a lateral distance sufficient to generally overlap at least a substantial portion of a trousers front-enclosure segment. A distal end of each flap panel is provided with a strip of Velcro-type hook material, with a first flap panel having its strip on an outer surface thereof and a second flap panel having its strip on an inner surface thereof. An inner or base end of each flap panel abutting the respective side area of the trousers rear-enclosure segment is provided with a plurality of aligned and spaced-apart strips of Velcro-type nap material, with the first flap panel having its plurality of strips on the outer surface thereof and the second flap panel having its plurality of strips on an inner surface thereof. During a closing operation, a wearer manipulates the first flap panel so as to overlap the trousers front-enclosure segment and secures the strip of hook material on its distal end with a select one of the plurality of strips of nap material on the base end of the second flap panel. Thereafter, the wearer manipulates the second flap panel so as to overlap the first flap panel and secure the strip of hook material on its distal end with a corresponding select one of the plurality of strips of nap material on the base end of the first flap panel.

11 Claims, 7 Drawing Figures

GARMENT CLOSURE

BACKGROUND OF THE INVENTION

1. Field of the Invention

The invention relates to closure devices and somewhat more particularly to garment closure devices.

2. Prior Art

A variety of closure devices for all types of goods, including garments, are known. Closure devices especially adapted for use in combination with garments require certain features. They should be capable of comfortably securing and maintaining a garment about the body of a wearer during anticipated activities and should be relatively dependable and non-obtrusive. Typical garment closure devices include hooks and eyes, lace-ups, snaps, buttons, zippers, elastic waist bands, drawstrings, webs, belts, hook and loop fasteners, etc.

Some relatively modern garments, such as jackets, shorts or even shoes, have fasteners formed from complementary strips or pieces of Velcro-type hook and nap or pile material. Generally, a strip of one type of Velcro material is secured along an edge of a garment to be fastened and another complementary strip of the opposing type of Velcro-type material is secured along a manipulative portion of such garment so that the wearer can bring the two complementary strips of Velcro material together to form a temporary closure. These types of closures are generally adequate for normal activities but are not sufficiently dependable for highly energetic activities, such as athletic activities, for example martial art competition, gymnastics, etc. There are presently known casual-wear type garments, such as shorts, which utilize a decorative belt or web (without a buckle) combined with strips of Velcro-type material to obtain a very non-obtrusive fastening means. In one of these type of casual garments, pairs of mating strips of Velcro-type material are respectively provided along inner front area edges of the shorts and along an end area and an opposing media area of a belt or web sewn about the waist area of the shorts, with the two ends of the web somewhat overlapping each other and positioning their respective strips of Velcro-type material in mating positions. This type of closure arrangement may be suspect of tending to accidentally open, even during normal activities, such as walking and does not provide any meaningful size adjustment feature.

Further, certain athletic garments require quick releasing-closing features, a traditional appearance, easy size adjustability, ready access to interior portions for adjustment of a body part or a protector therefore, etc. At present, available garment closures do not adequately provide these and other desirable features.

SUMMARY OF THE INVENTION

The invention provides an improved garment closure device. The garment closure device of the invention is adapted for use in combination with sporting garments, such as trousers or pants adapted to be worn about the lower torso of a person engaged in athletic events, such as martial arts competition, gymnastics, golf and other like activities.

The garment closure device of the invention, in combination with an athletic or sporting garment, revolutionizes traditional garment functionality and design by substantially eliminating most drawbacks and complaints associated with traditional or even custom athletic garments. By utilizing a garment closure device of the invention, athletic garments are attained which have a highly dependable, symmetrically neat, comfortable, non-abrasive, quick releasing-closing fastener or closure and have a selectively adjustable fit. In accordance with the principles of the invention, one garment is readily adjustable to fit a plurality of sizes. Further, the closure device of the invention avoids the disadvantages of drawstrings, lace-ups and the like, which tend to gather material at the waist of a wearer and are cumbersome to close or release, but instead provides a quick releasing-closing fastener or closure which is smooth, trim, and symmetrically neat in appearance at the smallest or largest adjustment. Closure devices or fasteners constructed in the course of the principles of the invention allow a wearer to quickly open-up the front of a garment, such as a trousers, provided with the same without the garment falling down and provide access to the interior thereof for any desired adjustment of body parts, undergarments, or protective devices worn under such garment.

In accordance with the principles of the invention, a highly dependable, symmetrically neat, non-abrasive, quick releasing-closing and selectively adjustable closure device useful on sporting trousers, such as marital art pants, or Gi pants is comprised of a pair of complementary juxtapositionable, somewhat triangularly shaped flap panels fromed of a select fabric and respectively secured at a base end thereof with a respective side seam or seam area of a trousers. Each flap panel extends along an upper edge thereof a lateral distance sufficient to generally overlap at least a substantial portion of the frontal area of a trousers so that each flap panel is selectively manipulatable to close the front area of the trousers from opposing sides thereof.

The fabric utilized to form the garment closure of fastener device of the invention is generally selected in accordance with the intended function of the overall garment and typically is identical with the fabric utilized to form the overall garment itself. The fabric can be selected from almost any known fabric type, including but not limited to, knit or double-knit materials which may be angled (biased) or straight, and composed of synthetic materials or man-made materials or blends thereof. All such fabrics include an outer surface and an inner surface which may be identical to one another except for their location relative to a wearer or one or the other surface may have a different or special treatment (such as a particular weave) from the other surface.

The closure device of the invention may comprise a simple extension of the garment combined therewith and may be formed of an identical fabric therewith. Alternatively, the closure device of the invention may be secured, as by sewing, gluing, weaving and the like, to select areas of the garment combined or provided therewith, and may be formed of a different fabric from that used in forming the majority of the garment. Each of the triangularly shaped flap panels is provided with a free distal end and an inner or base end abutting and secured along opposing side areas of the garment, such as a trousers. A diagonal edge interconnects a lower portion of the base end with a lower portion of the distal end. Each flap panel has a lateral extent sufficient to generally overlap at least a substantial portion of the front-enclosure area or segment of a trousers. During usage, each flap panel is selectively manipulatable to close or open the front enclosure area of the trousers. In the closed position one flap panel overlies the other flap panel.

The distal end of each flap panel may be provided with an edge wall of a given dimension or length or terminate in a point and is provided with a strip of Velcro-type hook material with a first flap panel having its strip of hook material located on the outer surface thereof and a second flap having its strip of hook material located on the inner surface thereof. The inner or base end of each flap panel is provided with a plurality of aligned and spaced-apart strips of Velcro-type nap or pile material, with the first flap panel having its plurality of strips of nap material located on the outer surface thereof and the second flap panel having its plurality of strips of nap material located on an inner surface thereof.

During a closing operation, a wearer manipulates, for example, the first flap panel so as to overlap the trousers front-enclosure area or segment and secures the strip of hook material on its distal end with a select one of the plurality of strips of nap material on the base end of the second flap panel. The wearer may select one of the plurality of strips of nap material in accordance with his/her waist size to attain a snug fit. Thereafter, the wearer manipulates the second flap panel in a somewhat similar manner and so as to overlap, for example, the first flap panel, and secure the strip of hook material on its distal end with, for example, a correspondingly selected one (although a next adjacent one may also be utilized) of the plurality of strips of nap material on the base end of the first flap panel.

In certain embodiments of the invention, an elasticized band may be secured on an inner surface of the rear-enclosure segment of the trousers along an upper edge thereof, and generally between the opposing plurality of aligned and spaced-apart strips of Velcro-type nap or pile material to ensure a snug fit during athletic activities.

In certain embodiments of the invention, the respective strips of nap material and hook material may be of substantially identical size. Further, to allow for size adjustments, a first plurality of aligned and spaced-apart strips of nap material may be uniformly spaced apart a given distance, such as one or two inches or two or four centimeters or other like corresponding dimensions. Similarly, the first and second plurality of aligned and spaced-apart strips of nap material can be uniformly spaced apart a similar or different distance. In order to attain a neat appearance, the various strips of hook and nap material may be aligned, such as parallel, with one another along the upper edge of each respective flap panel and be spaced an identical distance from a given reference point, such as the base end of each flap panel.

In certain embodiments of the invention, in order to attain greater freedom of movement and to provide improved reinforcement, a diamond-shaped crotch insert, or gusset, composed of a given fabric, such as the fabric forming the garment and/or the closure device of the invention, may be inserted and attached between upper inner edges of the leg-enclosure segments and the lower inner edges of the rear-enclosure and front-enclosure segments of the trousers to define a somewhat diamond-shaped crotch area. Further, in certain embodiments of the invention, in order to attain a snug fit about the legs of a wearer, each leg-enclosure segment may be provided with at least one relatively narrow fabric band or tiedown strap secured only at an inner end thereof to an outer wall of such leg-enclosure segment. Such fabric band may be formed of a given fabric, such as the fabric forming the garment itself and/or the closure device of the invention, and may be of a similar or contrasting color relative to the color of the leg-enclosure segment. Generally, such tiedown strap is generally located between an upper and lower area of a respective leg-enclosure segment. These fabric bands or tiedowns are typically of a length sufficient to encircle the leg-enclosure segment. Each fabric band may be provided with a strip of Velcro-type hook material secured to a surface of the band along an outer end thereof and with a like strip of Velcro-type nap material secured to the same surface of the band along an inner end thereof. Upon encirclement by the tiedown strap of the leg-enclosure segment, the strip of hook material selectively locks or mates with the strip of nap material. In certain of these embodiments, each of the pair of leg-enclosure segments may be provided with a spaced apart pair of such fabric bands or tiedown straps, with one of such bands being located along the leg-enclosure segment generally above the area thereof encompassing the knee joint (i.e., at about a midpoint of the thigh area) and the other band being located along the leg-enclosure segment generally below the area thereof encompassing the knee joint (i.e., at about a mid-calf area).

In accordance with the principles of the invention, the various strips of Velcro-type material utilized with the closure device of the invention are so arranged that upon closure, all strips of hook material are covered and out of contact with the person within the garment containing the same and also out of contact with any other person exterior of such garment so that, for example, during martial art competition, no abrasion of either competitor can occur due to the enclosure device of the invention.

Further and additional objects, features and advantages of the present invention will be apparent from the following description and claims, and are illustrated in the accompanying drawings, which, by way of illustration, shows certai preferred embodiments of the invention and the principle thereof, along with what is now considered to be the best mode contemplated for applying these principles. Other embodiments of the present invention embodying the same or equivalent principles may be used and structural changes may be made as desired by those skilled in the art without departing from the scope and spirit of the invention and falling within the purview of the appended claims.

DESCRIPTION OF PREFERRED EMBODIMENTS

Figure 1:
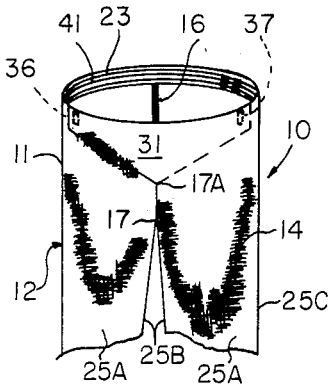
FIG. 1 is a partial, front prospective view, with portions in phantom, of a sporting trousers in combination with an embodiment of a closure device constructed and operable in accordance with the principles of the invention.

In the drawings, like reference numerals throughout the variouos Figures refer to like elements.

Referring now the the drawings in some detail, there is shown a garment closure device 10 of the invention associated with an athletic or sporting trousers 11. The garment closure device 10 of the invention may be constructed or formed from a fabric having the requisite characteristics for its intended function and be formed of the fabric from which the trouser 11 are formed. The fabric utilized to form the closure device of the invention may be formed from appropriate synthetic, manmade or natural fibers or fiber blends, woven, knit, spun or otherwise processed into select fabrics, such as cotton, linen, silk, wool, acetate, acrylic, modacrylic, nylon, olefin, polyester, rayon, spandex, triacetate and/or combinations thereof. The fabric structure may likewise be chosen from any available structure suitable for the intended use, such as variously woven fabrics, variously knit fabrics, felted fabrics, fused fabrics, bonded or laminated fabrics, braided fabrics, or combinations thereof.

A garment closure of fastener device constructed and operative in accordance with the principles of the invention is a highly dependable and secure closure providing a symmetrically neat, futuristic, yet traditional crossover appearance, is substantially non-abrasive to a wearer or another person coming into contact therewith, is relatively quick and easy releasing and quick and easy closing and is selectively adjustable to fit various sized individuals.

An exemplary embodiment of a closure device or means 10 constructed and operable in accordance with the principles of the invention is comprised of a select fabric 14 having an inner surface 14A and an outer surface 14B. The fabric 14 may be formed or constructed into a sporting or athletic garment, such as trousers 11, adapted for wear about a torso of a person (not shown). The trousers 11 are formed into a body enclosure 21 of a somewhat cylindrical shape 22 having a closed rear-enclosure segment 23 and an open or openable front-enclosure segment 24, along with a pair of leg-enclosure segments 25, joined with one another to form a unitary trouser-type garment, such as Gi pants 12, used in marital art competition. A crotch area 17 is defined between the various segments 23, 24 and 25.

The body enclosure 21 may be formed of a plurality of fabric pieces, such as two or more pieces, joined, as by sewing or gluing, along appropriate seams. Preferably, the number of such seams are kept to a minimum to minimize manufacturing costs and to provide minimum areas of abrasion or the like on the finished garment. In presently preferred embodiments, a single seam 16 extending downwardly from a center area of an upper edge 23B of the rear-enclosure segment 23, along the rear-enclosure segment to the crotch area 17 upwardly a relatively short distance to define a crotch riser area 17A and downwardly along the respective inner wall area 25B of each leg-enclosure segment 25, is utilized.

Figure 2:
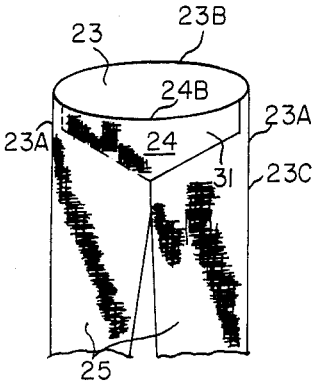
FIG. 2 is a somewhat similar view of another embodiment of a closure device constructed and operable in accordance with the principles of the invention.
Figure 3:
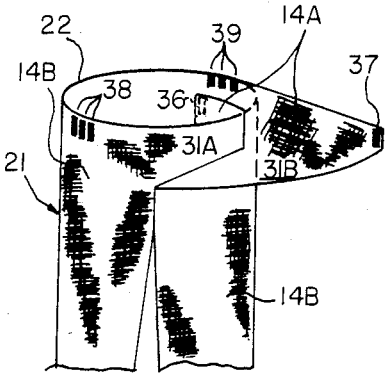
FIG. 3 is a somewhat similar view as in FIG. 1 but with one of the flap panels of the closure device of the invention in an opened position and the other flap panel in a partially closed position.
Figure 4:
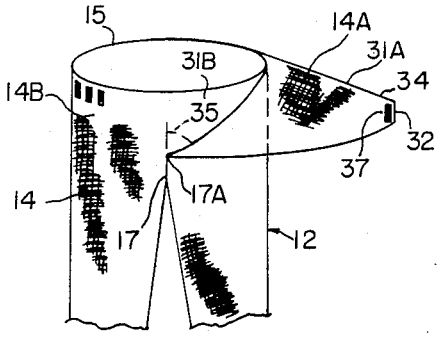
FIG. 4 is a view similar to that of FIG. 3 but with one flap panel of a closure device of the invention in a fully closed position and the other flap panel in an opened position.
Figure 5:
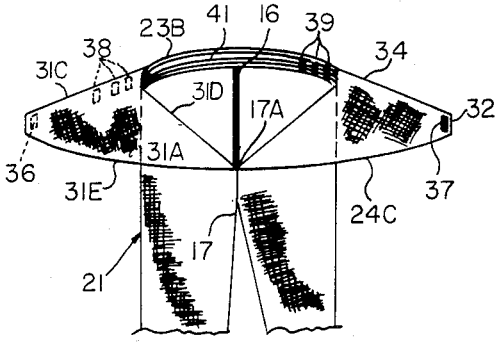
FIG. 5 is a view similar to that of FIG. 3 but with both flap panels of the closure device of the invention in an opened position.

The closure device or fastener means 10 of the invention is associated with or combined with a sporting garment of the type described, preferably in working association with an openable front-enclosure segment 24 of a trousers. The closure means 10 of the invention is comprised of a pair of complementary flap panels 31. Each respective flap panel 31A and 31B is of a somewhat triangular shape having an upper edge 31C (FIG. 5) and a base or inner edge 31D and a somewhat diagonal edge 31E joined together into a unitary piece with the remainder of the garment. A distal end 32 of each flap panel is free for manipulation. The respective lower edges 31D of each flap panel 31A and 31B terminate at the upper end of the crotch riser area 17A. The crotch riser area 17A generally extends upwardly from a standardized or true crotch area 17 a distance equal to about fifteen to about fifty percent, and more preferably from about twenty to about forty percent of the overall dimension between the crotch area 17 and the respective upper edges 31C of each flap panel in their closed position. This extent of the crotch riser area functions to prevent the trousers from simply falling down when both flap panels 31A and 31B are in a fully opened position such as shown in FIG. 5. A wearer can thus open the flap panels and make any desired adjustments of a body part or protector (not shown) therefor, within the trousers. In a presently preferred embodiment, the extent of the crotch riser area 17A is equal to about thirty percent of the overall dimension between the crotch area 17 and the upper edges 31C of each flap panel in their closed position (shown in FIGS. 1, 2 and 6). The angle 35 (FIG. 4) defined between the inner edge 31D and a center line extending through the crotch area, is generally on the order of about thirty to sixty degrees and preferably between about forty to about fifty degrees so as to provide a symmetrically neat appearance to the trousers when the flap panels are in a closed position. In a presently preferred embodiment, the angle 35 is about forty five degrees.

Each flap panel 31A and 31B respectively extend from opposing side edges 23A of the rear-enclosure segment 23 a distance sufficient to respectively overlap the front enclosure area. In this manner, each of the flap panels are selectively manipulatable by a wearer to close an opened front-enclosure segment 24 of the trousers 21.

As indicated earlier, an inner or base end 31D of each respective flap panel is secured to or forms a part of the rear-enclosure 23 of the trousers. Also as shown, each respective flap panel 31A and 31B is provided with a lateral extent 34 (FIG. 5) sufficient to generally overlap at least a substantial portion of the front-enclosure segment 24. The extent of the overlap may range from about one hundred to about eighty percent, and more preferably from about ninety to seventy five percent and preferably not less than about 60 percent of the lateral dimension of the front-enclosure segment 24 (ie., which segment is equal to about one half of the waist circumference of the trousers).

A first strip 36 of a hooked nap material, such as available under the trademark "VELCRO" (reported to be a registered trademark of Velcro Corporation, 681 Fifth Avenue, New York, N.Y. 10022) and which, for sake of brevity, will be referred to herein and in the claims as a Velcro-type hook material, is secured as by sewing, gluing or the like to the distal end 32 of a particular flap panel, such as a first flap panel 31A, on the inner fabric surface 14A thereof. A second strip 37 of Velcro-type hook material is secured in a like manner to the distal end of the other flap panel, such as second flap panel 31B on the outer fabric surface 14B thereof. A first plurality, such as plurality 38, of aligned, spaced-apart strips of looped nap material, such as available under the trademark "VELCRO" and which, for sake of brevity, will be referred to herein and in the claims as Velcro-type nap material, is secured, as by gluing, sewing or the like, along the upper inner end of a particular flap panel, such as a first flap panel 31A, on the outer fabric surface 14B thereof. A second plurality, such as plurality 39 of aligned, spaced-apart strips of Velcro-type nap material is secured in a like manner along the upper inner end of the other flap panel, such as second flap 31B, on an inner fabric surface 14A thereof.

In presently preferred embodiments of the invention, the various strips of nap material and strips of hook material are of substantially equal size. However, in certain instances, certain of the strips, for example the respective strips of hook material, may be of a larger size than those of the nap material, and may be large enough to simultaneously engage or mate with two adjacent strips of a plurality of strips of nap material. Further, in presently preferred embodiments of the invention, a given plurality of aligned and spaced-apart strips of nap material, such as the first plurality of strips 38 of Velcro-type nap material, are uniformly spaced apart a given distance corresponding, for example, to different standardized waist sizes. Similarly, in presently preferred embodiments of the invention, the opposing plurality of aligned, spaced-apart strips of nap material, such as the second plurality of strips 39 of Velcro-type nap material, are uniformly spaced apart a given distance, for example, likewise corresponding to the standardized waist sizes utilized in spacing the first plurality of strips 38 of the Velcro-type nap material. Of course, a given plurality or both of the pluralities of strips of nap material may be spaced differently if desired. Preferably, both pluralities of strips of nap material are uniformly spaced apart and are aligned parallel with one another and are aligned along the respective upper edges 31C of each respective flap panel 31A and 31B.

An elasticized band 41 may be secured along an upper edge 23B of the rear-enclosure segment 23. The elasticized band provides, in combination with the closure device 10, a safety feature and insures a snug fit about the waist of a person within the garment during all aspects of an athletic event. In embodiments where an elasticized band 41 is utilized, it is preferably secured to an inner surface of the rear-enclosure segment and extends along a substantial portion thereof. Preferably, the elasticized band extends approximately into abutting relation with an end strip of the respective plurality of strips of Velcro-type nap material.

During usage, when the respective strips of Velcro-type material are in face-to-face contact, a wearer can quickly obtain a release by grasping the distal end of the outermost flap panel and moving it perpendicularly away from the underlying strip of nap material. On the other hand, during athletic competition, as in a marital arts competition, competitors are most likely to apply stress in what can be termed as the sheer direction, which is the direction generally perpendicular to the conventional face-to-face direction of engagement. The closure device of the invention readily resists this type of stress. As one group of hooks of the Velcro-type hook material is disengaged from the nap material, another group of hooks comes into contact therewith and maintains the closure. Further, should an accidental release occur during a competition, a wearer merely reestablishes contact by simple hand pressure without the necessity of intricate eye-hand coordination so that competition can continue. Further, by having all of the strips of hook material covered during usage, no abrasion of the wearer or of another competitor can occur.

Figure 7:
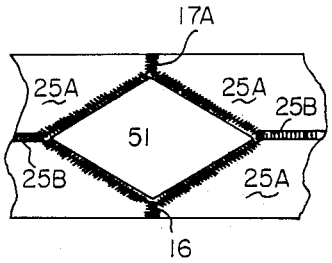
FIG. 7 is a partial, botton prospective view of a crotch area of a sporting trousers having an embodiment of the invention combined therewith.

The closure device 10 of the invention is especially useful in combination with a Gi uniform, such as Gi pants 12. As is known, Gi uniforms are utilized in marital art competition and as such may be subjected to extraordinary stress, particularly in and about the crotch area of the pants or trousers thereof. In order to obtain improved reinforcement and flexibility a somewhat diamond-shaped piece or gusset 51 (FIG. 7) formed of the garment fabric 14 is attached or secured, as by sewing with a double seam around all edges thereof, between upper inner edges of the individual leg-enclosure segments 25A and the lower inner edges of the rear-enclosure and front-enclosure segments 23 and 24 respectively.

Figure 6:
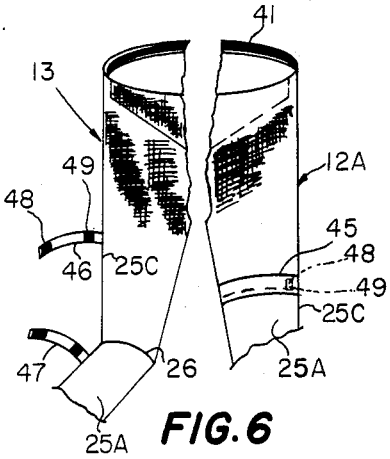
FIG. 6 is a partial front prospective view, with portions in phantom, of further embodiments of the invention.

For certain special athletic events or for more serious martial arts competition, the closure device of the invention may be combined with other specialized features, in addition to the diamond-shaped gusset just discussed. As shown in FIG. 6, at the right-hand portion thereof, custom Gi pants 12A may be provided with at least one relatively narrow leg tiedown strap or band 45. Generally, the band 45 is composed of a fabric and may be composed of the same fabric as utilized in forming the closure device of the invention or of some other fabric. The color of the leg band may be the same or different from that of the trousers. The band 45 is secured, as by sewing or gluing, only at an inner end thereof to an outer wall 25C of a particular leg-enclosure segment 25A. In embodiments where a leg tiedown strap or band 45 is utilized, it is generally located between the upper area of a leg enclosure segment and a bottom area thereof. Typically, when only a single tiedown strap is utilized on a leg-enclosure segment, it is preferably located at about the mid-thigh area, so as to provide a secure fit without hindering flexing or bending of the knee or binding of the leg tendons. The fabric leg band or tiedown strap 45 is of a length at least sufficient to encircle the leg-enclosure segment and is provided with a strip, such as third strip 48, of Velcro-type hook material secured to a surface of the tiedown band along an outer end thereof and with a strip, such as strip 49, of Velcro-type nap material secured to the same surface of the tiedown band along an inner end thereof. Upon encirclement by the band of the associated leg-enclosure segment, the strip of hook material locks or mates with the strip of nap material.

Further, as shown in FIG. 6, at the left-hand portion thereof, Ninja-style Gi trousers 13 may also be combined with the closure device of the invention along with a diamond-shaped crotch gusset 51 and a pair of fabric tiedown straps or bands 45, 47 on each respective leg-enclosure segment 25A. The bands 46 and 47 are essentially similar to the leg tiedown strap band 45, but are spaced apart from each other to encircle different portions of a wearer's leg. Generally, an upper fabric band, such as 46, is located along a leg-enclosure segment above a knee encompassing area 26 thereof, and preferably at about a mid-thigh area and a lower fabric band such as 47, is located along the leg enclosure segment generally below the knee encompassing area 26 thereof, preferably at about a mid-calf area. Each of the pair of tiedown bands 46 and 47 are, of course, provided with respective strips of Velcro-type hook material and Velcro-type nap material to enable each band to encircle its leg portion and be secured with such straps.

What is claimed is:

1. In combination with a sporting garment adapted for wear about a lower torso of a person, said garment being composed of a fabric having inner and outer surfaces and formed into a body enclosure of a somewhat cylindrical shape, said enclosure having a closed rear-enclosure segment and an openable front-enclosure segment along with a pair of leg enclosure segments respectively joined to one another to form a unitary trouser-type garment having a waist area along an upper area thereof and a crotch area between said leg-enclosure segments, along with a closure means associated with said front-enclosure segment, the improvement wherein said closure means comprises:

a pair of complementary juxtapositionable, somewhat triangularly-shaped flap panels respectively extending from opposing side edges of the rear-enclosure segment, said flap panels being selectively manipulatable to close said openable front-enclosure segment, each flap panel having a lateral extent sufficient to generally overlap at least a substantial portion of said front-enclosure segment;

a first strip of a Velcro-type hook material secured onto the outer surface of a first and said pair of said flap panels along a distal end thereof;

a first plurality of aligned and spaced-apart strips of Velcro-type nap material secured onto the inner surface of a second of said pair of flap panels along an upper inner end thereof;

a second strip of Velcro-type hook material secured onto the inner surface of the second of said pair of said flap panels along a distal end thereof; and a second plurality of aligned and spaced-apart strips of Velcro-type nap material secured onto the outer surface of the first of said pair of flap panels along an upper inner end thereof;

whereby during a closing operation, the first flap panel is laterally extended in a given direction over the front-enclosure segment of the body enclosure and the first strip of hook material is individually engaged with a select one of said first plurality of strips of nap material and the second flap panel is laterally extended in a direction opposite the said given direction over said first flap panel and the second strip of hook material is individually engaged with a select one of said second plurality of strips of nap material so that all strips of hook material are covered and out of contact with the person within such garment and out of contact with another person exterior of such garment.

2. In the combinations defined in claim 1 wherein said crotch area includes a crotch riser segment which extends upwardly from an upper joint area of the leg-enclosure segments a distance equal to about fifteen to fifty percent of the overall distance between said upper joint area of the leg-enclosure segment and the waist area.

3. In the combination defined in claim 1 wherein said strips of nap material and said strips of hook material are of substantially identical size.

4. In the combination defined in claim 1 wherein said first plurality of aligned and spaced-apart strips of nap material are uniformly spaced apart a given distance.

5. In the combination defined in claim 1 wherein said second plurality of aligned and spaced-apart strips of nap material are uniformly spaced apart a given distance.

6. In the combination defined in claim 1 wherein said first and second plurality of aligned and spaced-apart strips of nap material are uniformly spaced apart a given distance and are aligned along an upper edge of each respective flap panel.

7. In the combination defined in claim 1 wherein an upper edge of the rear-enclosure segment is provided with an elasticized band secured on an inner surface thereof and extends along a substantial portion of the lateral dimension thereof.

8. In the combination defined in claim 1 wherein said sporting garment is the lower portion of a Gi uniform.

9. In the combination defined in claim 8 wherein a somewhat diamond-shaped piece composed of the garment fabric is attached between the lower inner edges of the rear-enclosure and front-enclosure segments along upper inner joint edges of the leg-enclosure segments to define a somewhat diamond-shaped crotch area.

10. In the combination defined in claim 8 wherein each leg-enclosure segment is provided with at least one relatively narrow fabric band secured only at an inner end thereof to an outer wall of the leg-enclosure segment, said fabric band being located between an upper area of the leg-enclosure segment and a bottom area thereof, said fabric band being of a length sufficient to encircle the leg-enclosure segment and having a third strip of Velcro-type hook material secured to a surface of said band along an outer end thereof and a strip of Velcro-type nap material secured to said surface of said band along an inner end thereof whereby upon encirclement by the band of the leg-enclosure segment said third strip of hook material selectively mates with the strip of nap material.

11. In the combination defined in claim 10 wherein each of said pair of leg-enclosure segments is provided with a spaced apart pair of said fabric bands, one of said fabric bands being located along a leg-enclosure segment generally above an area encompassing a knee joint and the other fabric band being located along the leg-enclosure segment generally below the area enclosing said knee joint.

* * * * *